US005841415A

United States Patent [19]

Kwon et al.

[11] Patent Number: 5,841,415

[45] **Date of Patent: *Nov. 24, 1998**

[54] METHOD AND DEVICE FOR DRIVING AN LCD TO COMPENSATE FOR RC DELAY

[75] Inventors: Oh-Kyong Kwon; Kwang-Ho Lee, both of Seoul, Rep. of Korea

[73] Assignee: LG Semicon Co., Ltd., Cheongju, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 582,262

[22] Filed: Jan. 3, 1996

[30] Foreign Application Priority Data

Jul. 28, 1995 [KR] Rep. of Korea ..... 1995/22833

[51] Int. Cl.[6] ..... G09G 3/36

[52] U.S. Cl. ..... 345/90; 345/92

[58] Field of Search ..... 345/87, 92, 89, 345/93, 97, 100, 103, 95, 94, 90; 349/33, 41, 42, 46, 54

[56] References Cited

U.S. PATENT DOCUMENTS

| | | | |
|---|---|---|---|
| 4,386,352 | 5/1983 | Nonomura et al. | 345/92 |
| 4,818,991 | 4/1989 | Gay | 345/92 |
| 5,296,847 | 3/1994 | Takeda et al. | 345/92 |
| 5,300,945 | 4/1994 | Iemoto et al. | 345/92 |
| 5,598,285 | 1/1997 | Kondo et al. | 349/39 |

*Primary Examiner*—Chanh Nguyen
*Attorney, Agent, or Firm*—Fleshner & Kim

[57] ABSTRACT

In a method for driving LCD, common electrodes arranged between a glass substrate having transistors and a glass substrate having color filters are divided into a plurality of segmented electrodes, different compensating voltages are applied to corresponding segmented electrodes, and an error of a pixel voltage due to a RC delay of a gate line are compensated, so as to prevent degradation of a picture quality caused due to an RC delay of a gate line.

13 Claims, 5 Drawing Sheets

METHOD AND DEVICE FOR DRIVING AN LCD TO COMPENSATE FOR RC DELAY

BACKGROUND OF THE INVENTION

1. Field of the Invention

The present invention relates to a method for driving a liquid crystal display (referred to as an LCD, hereinafter), and more particularly to a method for driving an LCD by which common electrodes connected to liquid crystal capacitors are divided into a plurality of segmented electrodes and different compensating voltages are respectively applied to each segmented electrode to thereby prevent degradation of a picture quality due to an RC delay occurring at a gate line.

2. Description of the Prior Art

Referring to FIG. 1A, a conventional thin film transistor (TFT) LCD includes a controller 1 for outputting a control signal to a glass substrate 2; a gate driver for applying a gate line select signal to a gate line 5 in accordance with the output signal of the controller 1; a data driver for applying a video signal to a data line 6 in accordance with the output signal of the controller 1; and an LCD pixel array 7 for being driven by output signals of the gate driver 3 and the data driver 4.

The LCD pixel array 7 includes a plurality of LCD pixels. Each LCD pixel includes a thin film transistor 10 having a gate connected to the gate line 5 and a drain connected to the data line 6; a storage capacitor 8 of which one end is connected to a source of the thin film transistor 10 and the other end is connected to a common electrode node 11; and a liquid crystal capacitor 9.

The LCD pixel, according to a cross-sectional view shown in FIG. 1B, includes a polarizer film 13 through which a back light 12 is sequentially passed; a sodium barrier film 14; a glass substrate 2; a further sodium barrier film 14; a gate insulator 16; a transparent common electrode 21 connected to a thin film transistor 10; an orientation film 18; a space 20 filled with a liquid crystal 19; a further orientation film 18; a further transparent common electrode 21; a color filter overcoat 22; a color filter 23; a black matrix 24 for cutting off a light passed through the thin film transistor 10; a further sodium barrier film 14; another glass substrate 2; another sodium barrier film 14; and another polarizer film 13 for displaying a desired picture therethrough.

Referring to FIG. 2, an equivalent circuit of the LCD pixel, which has allowance for a parasitic capacitance existing between a source and a gate of the thin film transistor 10, includes two adjacent gate lines 5*a* and 5*b* and two adjacent data lines 6*a* and 6*b*; a thin film transistor 10 having the same connection as that of the LCD pixel; a storage capacitor 8; a liquid crystal capacitor 9; and a parasitic capacitance 25 of which one end is connected to a node 27 and the other end is connected to the gate line 5*b*.

The storage capacitor 8 for maintaining a voltage charged at the liquid crystal capacitor 9 is connected to a common electrode node 11 or to the adjacent gate line 5*a*.

The operation of the conventional thin film transistor LCD as constructed above will now be described.

The conventional thin film transistor LCD shown in FIG. 1 is a kind of AM(Active Matrix) LCD which is driven by a pulse driving method or by a capacitively coupled driving method.

The pulse driving method is described with reference to FIGS. 3A to 3D. A signal as shown in FIG. 3A is applied to the gate line 5*a* by the gate driver 3, and a signal as shown in FIG. 3B is applied to the gate line 5*b*. Accordingly, the thin film transistor 10 is turned on in accordance with the high level pulse signal applied to the gate line 5*b*. The video signals such as shown in FIG. 3C are charged at the storage capacitor 8 and the liquid crystal capacitor 9 through the data line 6*a*, and the brightness of the corresponding LCD pixel is determined by the level of the charged voltage. That is, the alignment direction of the liquid crystal molecules is changed by a voltage applied between the data storage node 27 and the common electrode node 11, and an image is displayed on the LCD panel according to the extent that a back light 12 passes through the liquid crystal molecules.

In this connection, in case that the high level pulse signal as shown in FIG. 3B is applied to the gate line 5*b* and the high level video signal as shown in FIG. 3C is applied to the data line 5*a*, a voltage level appearing on the common electrode node 11 is maintained constant as shown in FIG. 3D, while a voltage level appearing on the data storage node 27 is increased. Subsequently, when the signal applied to the gate line 5*b* is transitted from the high level to a low level, the voltage of the data storage node 27 decreased by as much as a constant voltage dVP due to the parasitic capacitance of the parasitic capacitor 25 existing between the source and the gate of the thin film transistor 10.

On the other hand, in case that the high level signal is applied to the gate line 5*b* and a low level video signal is applied to the data line 6*a*, a voltage level appearing on the data storage node 27 is reduced. Subsequently, when the signal applied to the gate line 5*b* is transitted from the high level to a low level, the voltage of the data storage node 27 is decreased by as much as a constant voltage dVP likewise as in the above case.

Then, a direct current voltage is applied to the liquid crystal due to the voltage reduction by dVP, causing a degradation in a picture quality. Therefore, in order to avoid such a problem, a method is used that a video signal compensated by as much as the voltage dVP is applied to the data line 6*a*, and a signal compensated by as much as the predetermined voltage dVP/2 is applied to the common electrode node 11. The above described capacitively coupled driving method was initially proposed by the Matsushita Company of Japan in 1990 and was improved upon in 1992 by the same company, for which, however, a large-scale integration circuit driven thereby has not yet been realized.

As to the capacitively coupled driving method, it is noted that one end of the storage capacitor 8 is connected to the node 27 and the other end is connected to the gate line 5*a* by which an aperture ratio of the pixel can be increased, but, the whole capacitance of the gate lines 5*a* and 5*b* is inadvantageously increased.

The capacitively coupled driving method will now be described in detail with reference to FIGS. 4A to 4C. In order to prevent a voltage reduction by dVP due to the parasitic capacitance existing between the gate and the source of the thin film transistor 10, signal waveforms as shown in FIGS. 4A to 4C are used.

A signal as shown in FIG. 4A is applied to the (2n−1)th gate line 5, a signal shown in FIG. 4B is applied to the (2n)th gate line 5, and a signal shown in FIG. 4C is applied to the (2n+1)th gate line 5, respectively. For instance, when the signal shown in FIG. 4A is applied to the gate line 5*a*, the signal shown in FIG. 4B is applied to the gate line 5*b*.

Accordingly, when a signal applied to a gate line of odd number-th is transitted from a high level to a low level, a signal applied to the gate line of an even number-th is transitted from a low level to a high level, so that a voltage charged at a liquid crystal capacitor included in the pixel would not be decreased.

However, even though the voltage decreased due to the parasitic capacitance can be compensated by using the pulse driving method and the capacitively coupled driving method, a problem can not be solved in that a pulse signal applied to the gate line is distorted by an RC delay of the gate line; resultantly causing a variation in the level of the pixel voltage charged at the liquid crystal capacitor.

That is, since the pulse applied to the gate line is delayed due to the RC delay, the falling time of the pulse signal applied to the gate line is varied according to the position of the thin film transistors each connected to one gate line. Thus, accordingly, a video signal is differently transmitted to the liquid crystal capacitors, and the level of the pixel voltages charged at the liquid crystal capacitors becomes varied, resulting in degradation in uniformity of the picture quality.

Such problems as described above will now be described in detail with reference to FIGS. 5, 6 and 7.

Referring to FIG. 5, in case of using the pulse driving method, the pixel voltage level is a value relative to a voltage charged on the liquid crystal capacitors positioned nearest to and farthest away from the gate driver and is measured to be smaller as a capacitance of the storage capacitor becomes larger and as a capacitance of the parasitic capacitor Cov becomes smaller. Also, the pixel voltage level is a value after an error of the pixel voltage, when the falling time of the signal applied to the gate line is 3 $\mu$sec, is compensated by the voltage applied to the common electrode node.

For instance, in case that the capacitance Cstg is 1.0 pF and the capacitance Cov is 0.04 pF, an error between the pixel voltages charged at the liquid crystal capacitors positioned nearest to and farthest away from the gate driver is 0.3 V.

FIG. 6 is a graph which shows a transmissivity of the liquid crystal in accordance with a voltage applied to a twisted nematic liquid crystal when a temperature of the liquid crystal is 30° C. and 60° C., indicating a voltage applied to the liquid crystal is transitted in a range of 1.5 V to 2.0 V.

Accordingly, a voltage error of 0.3 V may have much influence on the picture quality, and therefore the voltage error must be compensated for by using any method.

On the other hand, referring to FIG. 7, even in case of using the capacitively coupled driving method, likewise as in the use of the pulse driving method, it is noted that a considerable error exists in the level of the pixel voltage charged at the liquid crystal capacitors depending upon the position of the thin film transistors connected to the gate line.

In this respect, as the capacitance Cstg of the storage capacitor is increased, the aperture ratio is decreased. Thus, a problem arises in that the capacitance Cstg can not be just increased merely in order to reduce the voltage error.

As a possible solution, an algorithm for measuring the voltage error and converting video signals to an extent that the measured voltage error is compensated may be integrated at the data driver so as to compensate for the voltage error. However, since the voltage error is a function of variables such as the panel structure, the structure of a thin film transistor device, or the magnitude of the signal applied to a gate line, such an algorithm is difficult to implement.

SUMMARY OF THE INVENTION

Therefore, it is an object of the present invention to provide a method for driving an LCD for suitably preventing a degradation in picture quality due to the RC delay occurring at a gate line included in an LCD panel.

In order to obtain the above object, there is provided a method for driving an LCD having the steps of: dividing common electrodes arranged between a glass substrate having transistors and a glass substrate having color filters into a plurality of segmented electrodes; applying different compensating voltages to corresponding ones of the segmented electrodes; and thereby compensating for an error of a pixel voltage due to an RC delay of a gate line of the LCD.

In the plurality of the segmented electrodes, the common electrodes are divided perpendicularly to the gate line connected to a gate driver or divided irregularly according to shapes of pixel arrays included in the panel.

DETAILED DESCRIPTION OF THE INVENTION

The method for driving an LCD in accordance with the present invention will now be described with reference to FIGS. 8 and 9.

Figure 1A:
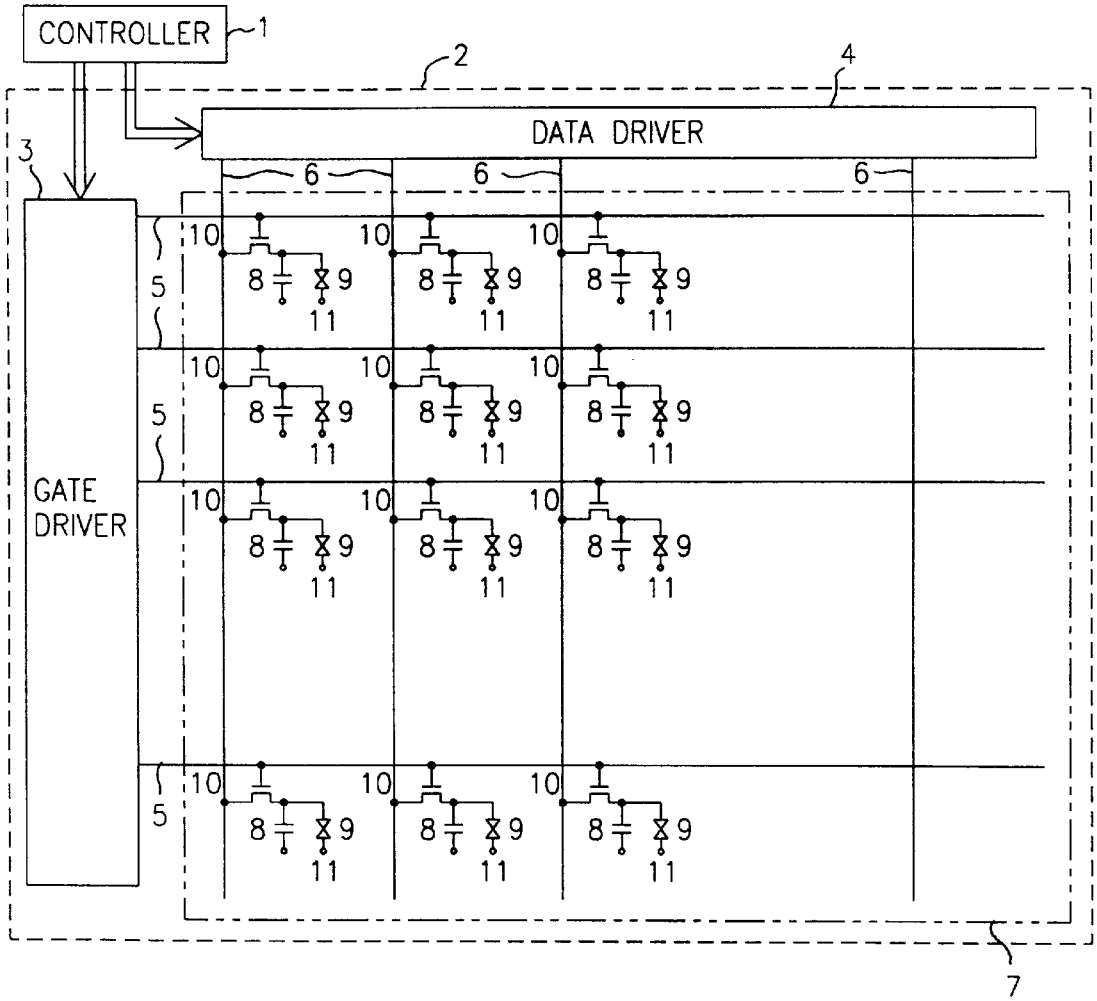
FIG. 1A CONVENTIONAL ART
FIG. 1A is a constructional view of a conventional thin film transistor LCD.
Figure 1B:
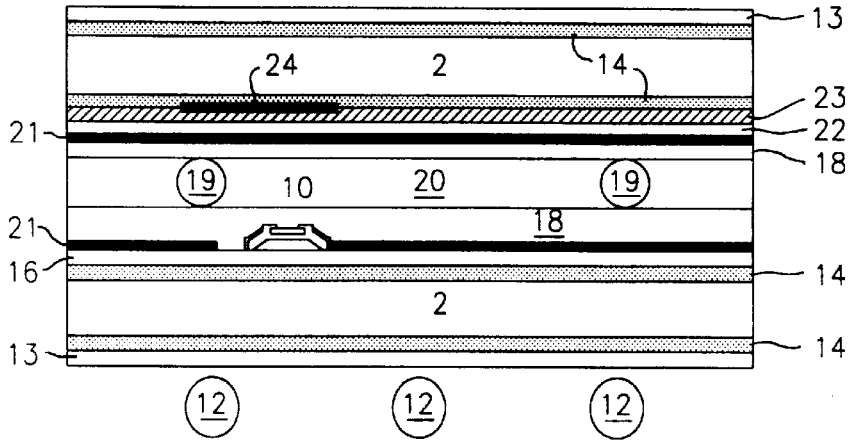
FIG. 1B CONVENTIONAL ART
FIG. 1B is a cross-sectional view of an LCD pixel structure of FIG. 1A.
Figure 2:
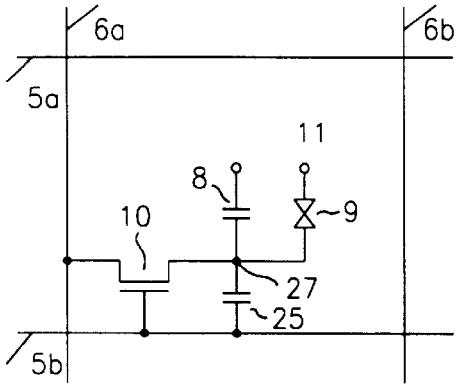
FIG. 2 CONVENTIONAL ART
FIG. 2 is an equivalent circuit diagram for the LCD pixel of FIG. 1B.
Figure 3A:
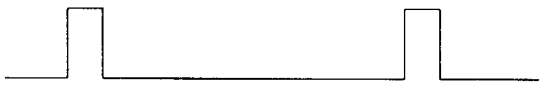
FIG.3A CONVENTIONAL ART
FIG. 3A shows a signal waveform applied to a gate line 5*a* of FIG. 2 according to a pulse driving method.
Figure 3B:
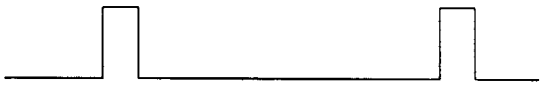
FIG.3B CONVENTIONAL ART
FIG. 3B shows a signal waveform applied to a gate line 5*b* of FIG. 2 according to a pulse driving method.
Figure 3C:
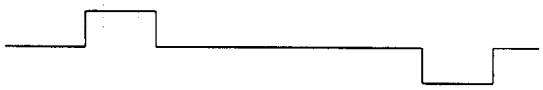
FIG.3C CONVENTIONAL ART
FIG. 3C shows a signal waveform applied to a data line 6*a* of FIG. 2 according to the pulse driving method.
Figure 3D:
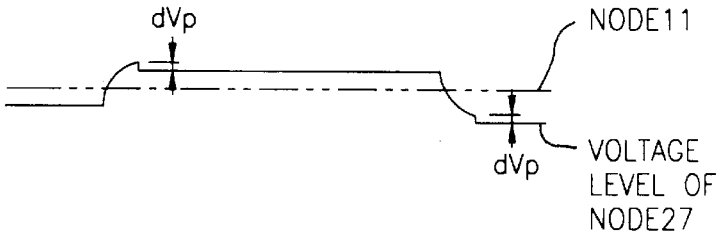
FIG.3D CONVENTIONAL ART
FIG. 3D shows a signal waveform appearing on each node of FIG. 2.
Figure 4A:
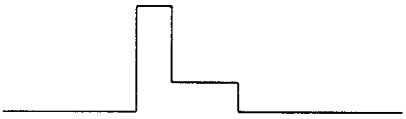
FIG.4A CONVENTIONAL ART
FIG. 4A shows a signal waveform applied to the (2n−1)th gate line of FIG. 2 according to the capacitively coupled driving method.
Figure 4B:
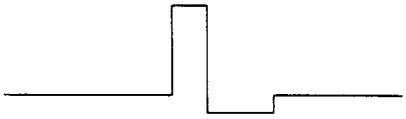
FIG.4B CONVENTIONAL ART
FIG. 4B shows a signal waveform applied to the (2n)th gate line of FIG. 2 according to a capacitively coupled driving method.
Figure 4C:
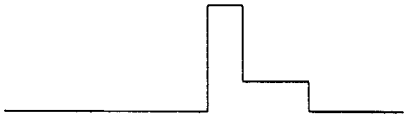
FIG.4C CONVENTIONAL ART
FIG. 4C shows a signal waveform applied to the (2n+1)th gate line of FIG. 2 according to the capacitively coupled driving method.
Figure 5:
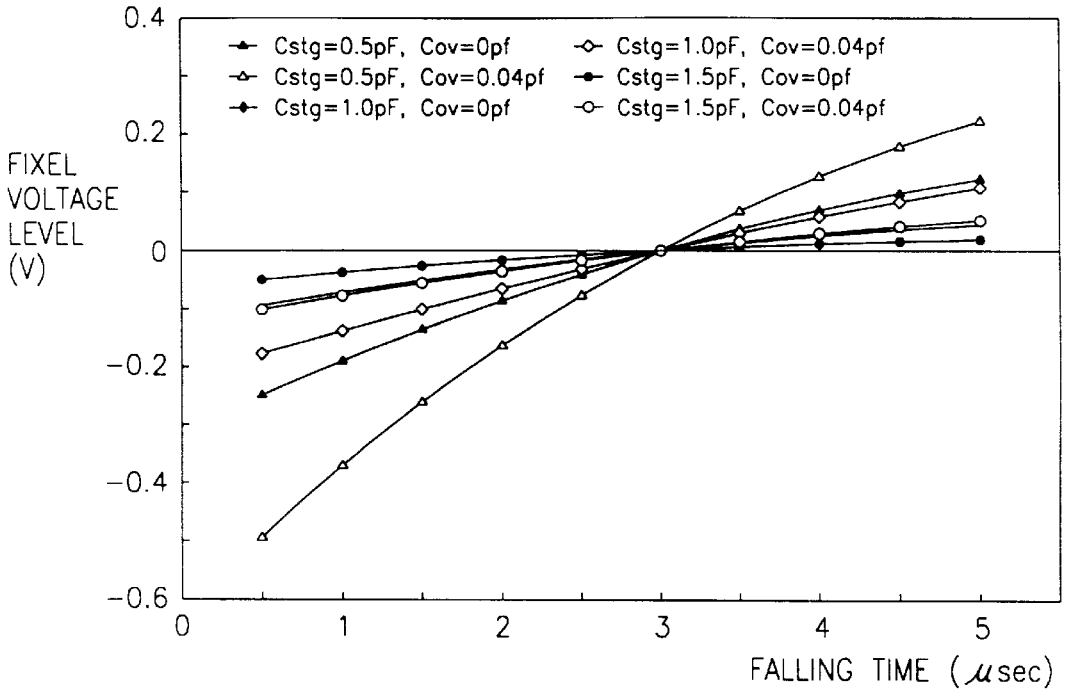
FIG. 5 CONVENTIONAL ART
FIG. 5 is a graph showing pixel voltage measured in accordance with a parasitic capacitance of a storage capacitor when a falling time of a signal applied to a gate line is 3 $\mu$sec in the pulse driving method.
Figure 6:
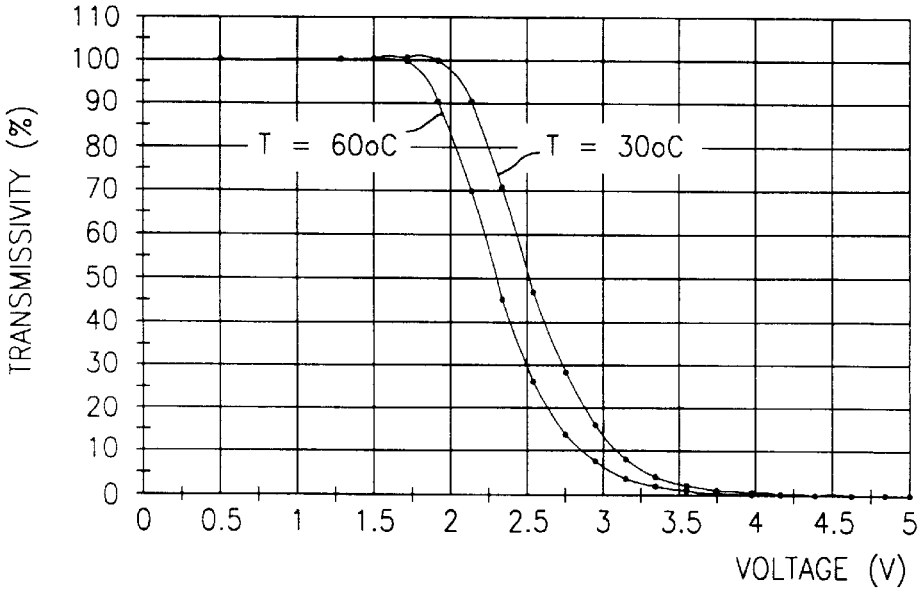
FIG. 6 CONVENTIONAL ART
FIG. 6 is a graph showing the transmissivity of a liquid crystal measured at temperatures of 30° C. and 60° C. in accordance with a voltage applied to the liquid crystal.
Figure 7:
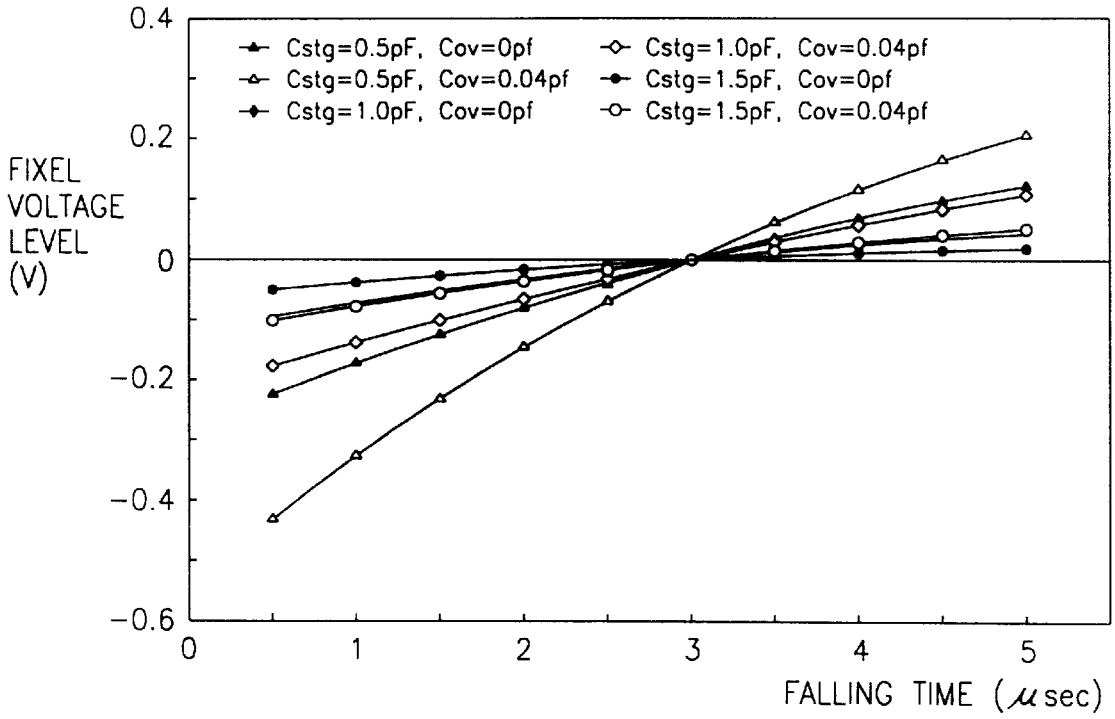
FIG. 7 CONVENTIONAL ART
FIG. 7 is a graph showing a pixel voltage measured in accordance with a parasitic capacitance of a storage capacitor based on that a falling time of a signal applied to a gate line is 3 $\mu$sec in the capacitively coupled driving method.
Figure 8:
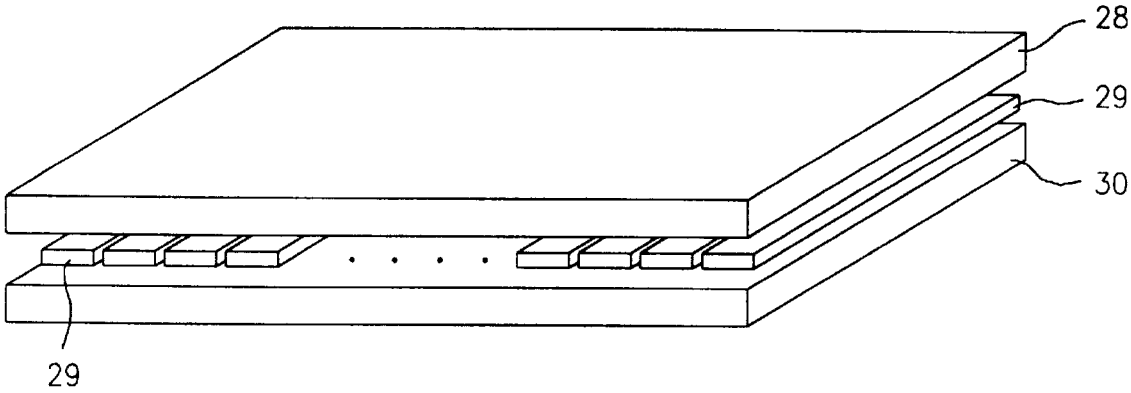
FIG. 8 shows an LCD panel structure with segmented common electrodes in accordance with the present invention.
Figure 9:
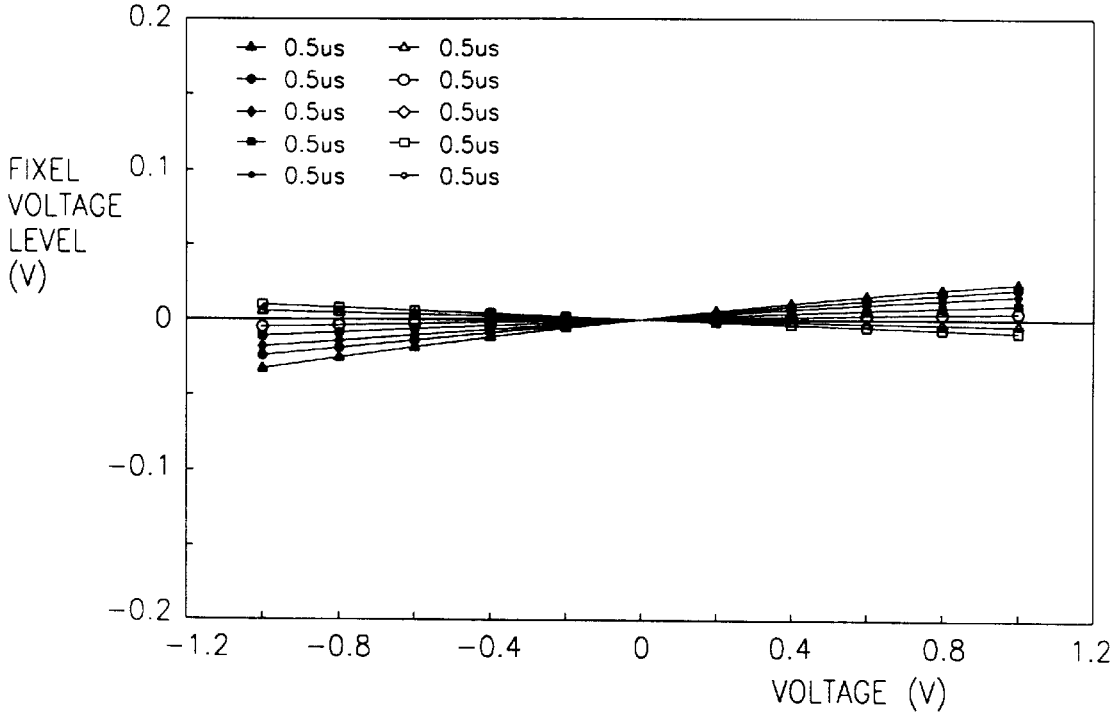
FIG. 9 is a graph showing a pixel voltage measured in accordance with a falling time of a signal applied to a gate line based on a video signal of 0 V in case of using the capacitively coupled driving method for the present invention.

As shown in FIG. 8, an LCD panel has a construction whereby a plurality of segmented electrodes 29 are arranged between a glass substrate 28 having thin film transistors and a glass substrate 30 having color filters. As to the plurality of segmented electrodes 29, common electrodes (referred to FIG. 1) are divided perpendicularly to a gate line (referred to FIG. 1).

In the method for driving an LCD in accordance with the present invention, the error voltages of video signals applied to liquid crystal capacitors connected to the thin film transistors are measured according to a difference caused due to an RC delay of the gate line between pulse signals applied to the thin film transistors positioned at the nearest and the farthest locations from a gate driver caused due to an RC delay of the gate line. Then, the common electrodes are divided into the plurality of segmented electrodes 29 in consideration of the measured voltage error, and different compensating voltages are respectively applied to the segmented electrodes 29, so as to compensate for the voltage error.

For instance, in case that the common electrode nodes are divided into ten segmented electrodes and different compensating voltages depending on the capacitively coupled driving method are applied to the segmented electrodes, respectively, the error in a pixel voltage charged at liquid crystal capacitors each positioned at the nearest and the farthest locations from the gate driver is shown to be below 40 mV.

In this respect, it is assumed that a capacitance of the storage capacitor is 1.0 pF and a parasitic capacitance is 0.04 pF.

Also, as to adopting the pulse driving method to the present invention, likewise as in the above method, it has been ascertained by a simulation that the error of the pixel voltage is decreased by more than 7 to 8 times.

In the meantime, pixel arrays included in the LCD panel may have various forms according to the objectives of the producer, so that common electrodes are irregularly divided according to the error in a measured pixel voltage and different compensating voltages can be applied to the segmented electrodes.

As so far described, according to the method for driving LCD of the present invention, the common electrode nodes connected to the liquid crystal capacitor are divided perpendicularly to the gate line and different compensating voltages are respectively applied to the plurality of the segmented electrodes, so that the error in the pixel voltage caused due to the RC delay time of the gate line can be reduced and the picture quality of the LCD panel is thereby highly improved.

What is claimed is:

1. A method for driving pixels in a display device comprising the steps of:

arranging a plurality of common electrodes between a first substrate having transistors and a second substrate having filters; and applying different compensating voltages to respective ones of groups of common electrodes to compensate for variations in a respective pixel voltage due to a delay time of a gate line that is based on a distance of each of said groups to a gate driver.

2. The method according to claim 1, wherein the plurality of common electrodes are arranged perpendicularly to the gate line connected to a gate driver.

3. The method according to claim 1, wherein the compensating voltage applied to the plurality of common electrodes differs respectively according to the delay time of the gate line.

4. The method according to claim 1, wherein the delay time is an RC delay time.

5. The method according to claim 1, wherein in said compensating voltage, different voltages are applied to each of the groups in accordance with the delay time of the gate line.

6. An LCD driving device, comprising:

a plurality of transistors each connected with a corresponding gate line, wherein in said each of the transistors an error value of a video signal applied to LCD capacitors, respectively, is measured based on a difference between pulse signals applied to the transistors; and a more than two groups of electrodes, which are divided from common electrodes connected with a corresponding one of the LCD capacitors in accordance with the measured error value, and wherein different compensating voltages are applied to each of the more than two groups of electrodes, respectively.

7. The device according to claim 6, wherein the more than two groups of electrodes, are grouped perpendicularly to the gate lines and are grouped irregularly in accordance with shapes of pixel arrays.

8. A display device, comprising:

a first driver;

a second driver;

a plurality of pixels respectively coupled to the first and second drivers using control and first electrodes; and a plurality of common electrodes coupled to said pixels, wherein the common electrodes comprise more than two groups of common electrodes, and wherein each of the more than two groups of common electrodes receive a different compensating voltage based on a distance from the first driver.

9. The device of claim 8, wherein the more than two groups of common electrodes are irregularly divided according to shapes of pixel arrays.

10. The device of claim 8, wherein the first and second drivers are gate and data drivers, respectively.

11. The device of claim 10, wherein the common electrodes extend in a first direction substantially perpendicular to gate lines coupled to the gate driver.

12. The device of claim 8, wherein the more than two groups of common electrodes each comprise sets of adjacent common electrodes.

13. The device of claim 8, wherein the common electrodes are coupled between a first substrate including a plurality of transistors and a second substrate including a plurality of filters.

* * * * *